US009297594B2

(12) United States Patent
Riondet et al.

(10) Patent No.: US 9,297,594 B2
(45) Date of Patent: Mar. 29, 2016

(54) COLLECTOR PLATE FOR A HEAT EXCHANGER, AND HEAT EXCHANGER INCLUDING SUCH A PLATE

(75) Inventors: Christian Riondet, Bourgogne (FR); Jean-Marc Lesueur, Boult sur Suippe (FR); Alan Day, Reims (FR); Paul Garret, Veneux les Sablons (FR); Eric Piniarski, Bazancourt (FR); Claire Piniarski, legal representative, Bazancourt (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 897 days.

(21) Appl. No.: 13/127,867

(22) PCT Filed: Nov. 2, 2009 (Under 37 CFR 1.47)

(86) PCT No.: PCT/EP2009/064475

§ 371 (c)(1), (2), (4) Date: Dec. 23, 2011

(87) PCT Pub. No.: WO2010/052194

PCT Pub. Date: May 14, 2010

(65) Prior Publication Data

US 2012/0097379 A1 Apr. 26, 2012

(30) Foreign Application Priority Data

Nov. 6, 2008 (FR) ..... 08 06185

(51) Int. Cl.
*F28F 9/02* (2006.01)

(52) U.S. Cl.
CPC ..... *F28F 9/0226* (2013.01)

(58) Field of Classification Search
CPC ..... F28F 9/0226; F28F 9/12; F28F 9/14; B65D 2543/00101; B65D 2543/0012; B65D 2543/00435; B65D 2543/0444; B65D 2543/00722; B65D 2543/00731; B65D 2543/00768; B65D 43/06; B65D 43/065
USPC ..... 165/173, 175, 178, 76, 153, 149; 220/571, 617, 618, 784, 788, 790
See application file for complete search history.

(56) References Cited

U.S. PATENT DOCUMENTS 4,023,618 A * 5/1977 Kun et al. ..... 165/175
4,159,062 A * 6/1979 Levenhagen ..... 220/4.21

(Continued)

FOREIGN PATENT DOCUMENTS

FR 2875593 A1 3/2006
JP 2005326124 A 11/2005

OTHER PUBLICATIONS

English language abstract for FR 2875593 extracted from the EPO machine translation on Dec. 28, 2011, 27 pages.

(Continued)

*Primary Examiner* — Judy Swann
*Assistant Examiner* — John Higgins
(74) *Attorney, Agent, or Firm* — Howard & Howard Attorneys PLLC

(57) ABSTRACT

The invention relates to a collector plate (10) for a heat exchanger comprising a web (12) equipped with openings for the passage of tubes of the heat exchanger and a groove (14), known as a receiving groove, to accept a header tank cover, able to accept a gasket (104) and part of the cover and having a base (18) and two flanges, respectively an inner flange (16) and an outer flange (20) which are connected to the base (18). The inner flange (16) is connected to the web (12) and is subdivided into at least two disjointed portions, the two disjointed portions are separated by at least one recess (30), and the recess (30) between the two disjointed portions of the inner flange (16) is at least in the region of a site of the collector plate (10) that is intended to accept a bent part of the gasket (104). The invention also relates to a heat exchanger comprising the collector plate (10).

7 Claims, 4 Drawing Sheets

(56) References Cited

U.S. PATENT DOCUMENTS

| | | | | |
|---|---|---|---|---|
| 5,664,625 | A * | 9/1997 | Letrange et al. | 165/173 |
| 5,758,721 | A * | 6/1998 | Letrange et al. | 165/173 |
| 6,988,544 | B2 * | 1/2006 | Ozaki et al. | 165/173 |
| 7,156,401 | B2 | 1/2007 | Merklein et al. | |
| 7,237,605 | B2 * | 7/2007 | Ozaki | 165/173 |
| 2007/0187277 | A1 * | 8/2007 | Furlong | 206/515 |
| 2008/0000626 | A1 * | 1/2008 | Sugito et al. | 165/173 |
| 2008/0121386 | A1 | 5/2008 | Hakamata et al. | |

OTHER PUBLICATIONS

English language abstract for JP 2005326124 extracted from the espacenet.com database on Dec. 28, 2011, 9 pages.

International Search Report for Application No. PCT/EP2009/064475 dated Sep. 12, 2009, 5 pages.

* cited by examiner

COLLECTOR PLATE FOR A HEAT EXCHANGER, AND HEAT EXCHANGER INCLUDING SUCH A PLATE

RELATED APPLICATIONS

This application claims priority to and all the advantages of International Patent Application No. PCT/EP2009/064475, filed on Nov. 2, 2009, which claims priority to French Patent Application No. FR 08/06185, filed on Nov. 6, 2008.

The invention relates to a collector plate for a heat exchanger and to a heat exchanger equipped with such a plate.

It relates more particularly to a collector plate for a heat exchanger comprising a web equipped with openings for the passage of tubes of the heat exchanger and a groove, known as a receiving groove, to accept a header tank cover, able to accept a gasket and part of the cover and having a base and two flanges, respectively an inner flange and an outer flange which are connected to the base.

Heat exchangers comprising a core of tubes and of inserts, two collector plates and two covers are known.

During the manufacture of the heat exchanger, the core of tubes and inserts is first of all assembled. Next, the two collector plates are assembled on the ends of the tubes of the core. This assembly is then placed in a brazing furnace where these various components will be brazed together. Finally, using crimping and with the interposition of a gasket positioned in the groove, a cover is secured to each collector plate to define a header tank capable of collecting the fluid that is circulated through the tubes of the heat exchanger. In a collector plate according to the prior art, the receiving groove is present around the entire periphery of the collector plate.

The fitting of the gasket into this groove is particularly awkward for an operator to perform because of the narrowness of the groove. Such a collector plate leads to a significant loss of time upon assembly, and may even lead to the gasket being incorrectly positioned.

The invention aims to improve the situation.

To this end, it proposes a collector plate like the one defined hereinabove, in which the inner flange is connected to the web and is subdivided into at least two disjointed sections, said two disjointed sections being separated by at least one recess, and the recess between two disjointed portions of the inner flange being at least in the region of a site of the collector plate that is intended to accept a bent part of the gasket.

Such a collector plate therefore does not have an inner flange at least in the region of a bend (or corner) of the outer flange. In other words, the inner flange is provided partially along the edges of the collector plate. Thus, a collector plate according to the invention has more space at least in the region of its corners, so that a gasket can be fitted more easily by an operator.

Particular embodiments of the invention propose that:

- the collector plate has a periphery and said outer flange is continuous around the periphery of the collector plate and has substantially straight portions opposite one another in pairs and connected by bends and in which the disjointed sections of the inner flange face at least two of said opposing straight portions of the outer flange,
- said groove has at least two substantially parallel sides and the two disjointed sections are placed facing one another, each on one of said parallel sides,
- said web has at least two levels, known respectively as the upper level and the lower level, which are situated in two distinct planes, one of said levels being situated in the region of the recess between two disjointed portions,

- said base of said receiving groove and said lower level extend in one and the same plane known as the first plane,
- an opening for the passage of an end tube is situated level with said lower level, said end tube and/or a flange of the collector plate surrounding said end tube being capable of retaining a gasket,
- the recess between two disjointed portions of said inner flange is positioned facing two bends and one side, known as the short side, of the outer flange, said short side being contiguous with said two bends,
- the receiving groove and the web are made in two different components,
- said outer flange comprises four straight portions opposite one another in pairs, each straight portion being connected to an adjacent straight portion by a bend, and said inner flange at least partially faces said four straight portions so as to define four recesses facing each bend,
- said inner flange is connected to said base by a connecting zone comprising a rounded and inclined edge.

The invention also proposes that:

- the collector plate for a header tank of a heat exchanger comprises a plurality of orifices suited to the fixing of tubes, a first protruding part accompanying a majority of said orifices so as to form a peripheral groove, in which plate at least one of said end orifices is situated in a flat zone and, more particularly, a flat zone situated in the region of the peripheral groove of the collector plate,
- two end orifices one on each side of the collector plate are situated in a flat zone,
- the collector plate comprises a second part, known as the flat part and/or the inclined-plane part, in which the orifices are flanged,
- the inclined-plane part of the second part comprises a plurality of orifices,
- the inclined-plane part has an inclination that makes an angle $\beta$ of between 0 and 35° with respect to the horizontal, preferably of between 15° and 25°,
- the collector plate comprises two second parts respectively situated at the two opposite ends of the collector plate,
- the collector plate comprises crimping teeth or the like, situated on at least part of the end edges of the collector plate and capable of being attached by crimping to part of a cover.

The invention also relates to a header tank for a heat exchanger, comprising at least one cover fixed to a collector plate as described hereinabove.

Particular embodiments of the invention propose that:

- the cover is fixed to the collector plate by the crimping of teeth, or the like, which are present around the periphery of the collector plate; a gasket being present and positioned at least in part between the foot (or lower part) of the cover and the collector plate,
- the gasket is stretched around the end tubes.

The invention also relates to a heat exchanger comprising a collector plate as described above. More particularly, the heat exchanger may comprise a heat exchange core for the exchange of heat between at least two fluids.

One particular embodiment proposes that the heat exchanger comprises at least one cover, said cover comprising an end, known as the foot of the cover, that is introduced into the receiving groove and comprises a protrusion that faces the recess of the inner flange, the protrusion filling the recess of the inner flange so as to create a junction between the two disjointed sections located on each side of the recess.

Further advantages and features of the invention will become more evident from reading the illustrative and non-limiting description of examples taken from the figures of the attached drawings in which:

FIG. 1 schematically depicts a view in cross section of a collector plate fitted with a cover.

Figure 1:
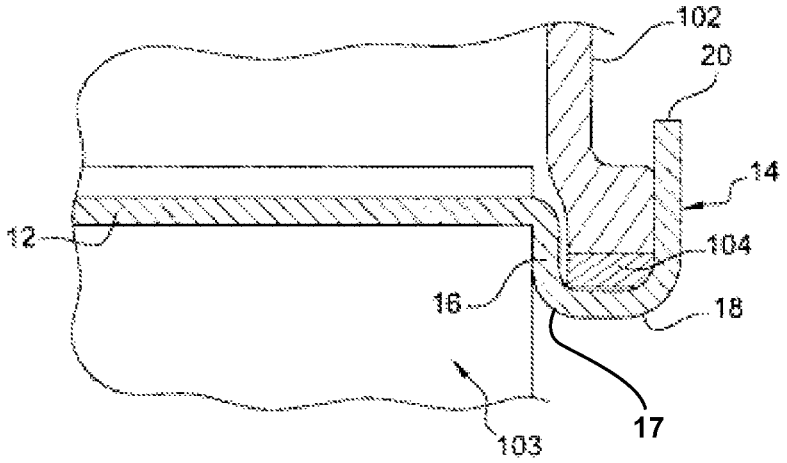

As has been illustrated, the invention relates to a collector plate 10 for a heat exchanger. The collector plate 10 comprises a web 12 equipped with openings for the passage of tubes 100 of the heat exchanger and a groove 14, known as the receiving groove for accepting a header tank cover 102, able to accept a gasket 104 and part of the cover known as the foot of the cover. In other words, the groove 14 allows a gasket 104 or the like to be positioned and held relatively securely, once it has been fitted, until it is fixed in position with a cover, more particularly the foot of the cover.

The collector plate 10 has a periphery which here is of substantially rectangular shape having two sides 22 known as long sides and two sides 24 known as short sides.

The body of the collector plate 10 is made of metal, for example aluminum or an aluminum alloy. In other words, the collector plate 10 comes from a strip of sheet metal.

Moreover, all the operations performed on the collector plate of the invention are performed using known industrial processes, particularly pressing, cutting, bending, stamping.

Thus, the collector plate 10 can be viewed as comprising at least two sides situated facing one another, namely respectively the two long sides 22 and the two short sides 24. The two short sides 24 may hereafter be denoted by the term "ends of the collector plate".

As already indicated above, the web 12 comprises holes (or orifices) to accept the ends of tubes 100 of the heat exchanger and matched to the shape of their ends.

Figure 2:
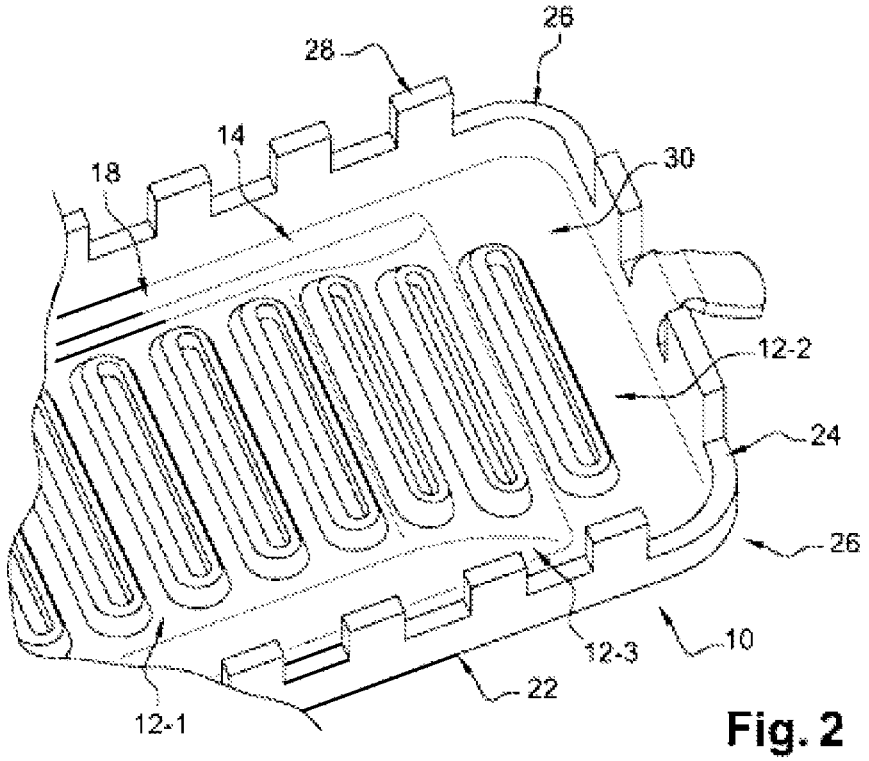
FIG. 2 depicts a view of a collector plate according to a first embodiment, viewed from the inside of said collector plate.
Figure 3:
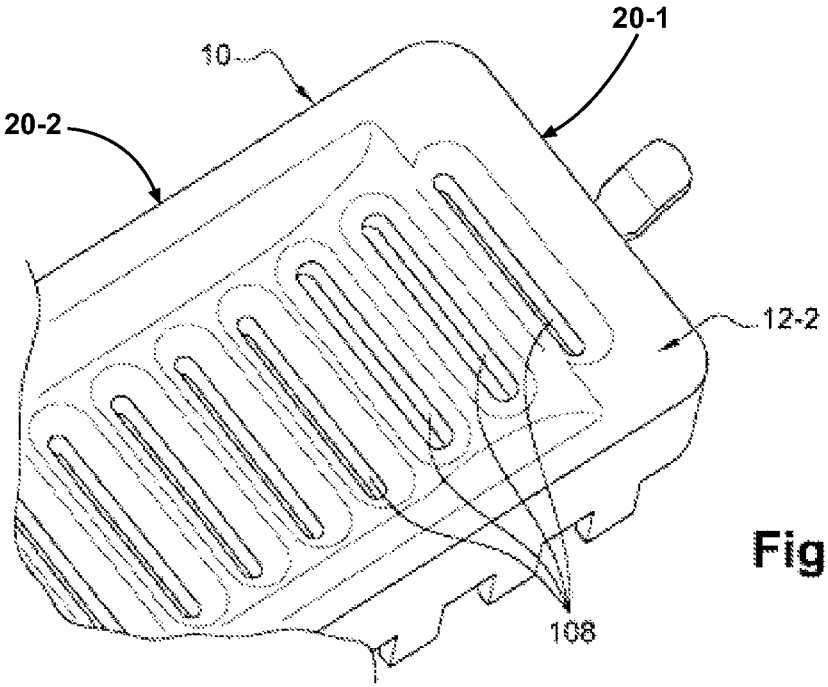
FIG. 3 is a view of the collector plate of FIG. 2, as viewed from the outside of said collector plate.
Figure 4:
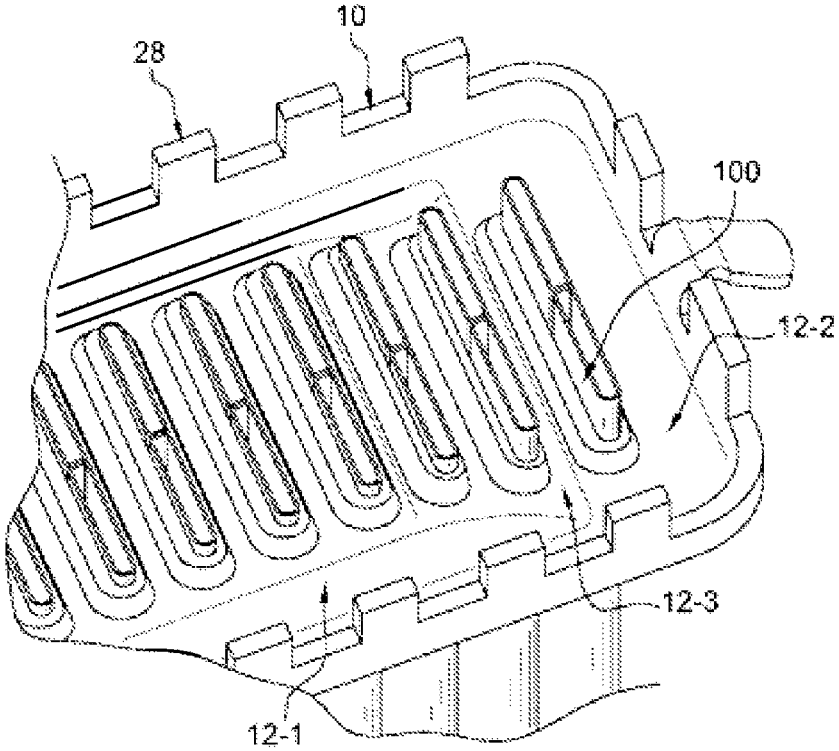
FIG. 4 depicts the collector plate according to the invention, viewed from the inside, in the same embodiment as that of FIGS. 2 and 3, with tubes fixed in its orifices.

Here, and as may be seen in FIG. 2, the holes are each surrounded by a flange that has two pairs of opposite sides.

In this embodiment, the flanges face toward the inside of the collector plate or, more precisely, toward the inside of the header tank. In other words, once the cover 102 has been mounted on the collector plate 10, the flanges will extend into the volume defined by the collector plate 10 and the cover 102.

One embodiment that has not been depicted makes provision for the flanges to be able to extend not toward the inside of the header tank but toward the body of the tubes 100. In other words, in such a situation, the flanges will be directed toward a heat exchange core comprising tubes and inserts.

These flanges may be formed by punching and turning up the plate or by lancing the plate.

The receiving groove 14 here is in the shape of a U over at least part of the periphery of the collector plate 10 and comprises a base 18 and two flanges 16 and 20 these respectively being an inner flange 16 and an outer flange 20 both of which are connected to the base 18.

In other words, the shape of the groove can be seen as a three-sided structure with a base 18 extending in a first plane and two flanges 16 and 20 substantially perpendicular to said first plane.

The outer flange 20 (which could also be termed the peripheral flange 20) is itself that part of the receiving groove 14 that is furthest away from the holes for the passage of the tubes 100. The outer flange 20 is continuous around the periphery of the collector plate and has a shape comprising substantially straight portions opposite one another in pairs and connected by bends.

The substantially straight portions correspond, in the embodiments illustrated here, to the sides of the collector plate, that is to say the long sides 22 and the short sides 24. The bends themselves coincide with the corners 26 of the collector plate 10.

In other words, the collector plate has an outer flange 20 that comprises four straight portions 20-1 and/or 20-2 that are opposite one another in pairs, each straight portion 20-1 and/or 20-2 being connected to an adjacent straight portion 20-1 and/or 20-2 by a bend 26. The collector plate 10 also has an inner flange 16 positioned at least partially facing said four straight portions 20-1 and/or 20-2 so as to define four recesses 30 facing each bend 26.

One particular embodiment proposes for the inner flange 16 to be connected to the base 18 by a connecting zone comprising a rounded and inclined edge 17 so as not to damage a gasket fitted in the groove 14.

In this embodiment, the outer flange 20 comprises crimping teeth or crenellations 28. These teeth 28 are distributed along the outer flange 20. In other words, the collector plate comprises crimping teeth 28 which are situated at least over part of the end edges of the collector plate, these teeth being able to secure part of the cover by crimping. The crimping teeth 28 may be obtained by cutting out. Other modes of attachment of the cover to the collector plate 10 could be considered.

The inner flange 16 is connected to the web 12. In other words, here, the web 12 and the inner flange are in continuity of material. Put differently, it is that part of the receiving groove 14 which is the closest to the holes for the passage of the tubes 100.

According to the invention, the inner flange 16 is subdivided into at least two disjointed sections, said two disjointed sections being separated by at least one recess 30 and the recess 30 between two disjointed portions of the inner flange 16 being at least in the region of a site of the collector plate 10 that is intended to accept a bent part of a gasket.

In other words, the recess 30 between two disjointed portions of the inner flange 16 is at least positioned facing a bend 26 of the outer flange 20.

Thus, the inner flange 16 can be seen as being formed as an alternation of crenellations spaced apart by gaps. In other words, the inner flange 16 is interrupted at points and, according to the invention, at least at one corner of the collector plate 10.

In the embodiments illustrated here, the disjointed sections of the inner flange 16 are situated facing at least two of said opposing straight portions of the outer flange 20.

In the embodiment illustrated in FIGS. 2 to 5, the web 12 has at least two levels, known respectively as the upper level 12-1 and the lower level 12-2, which are situated in two distinct planes, and here, connected by a portion known as the intermediate portion 12-3.

The upper level 12-1 can also be dubbed the protruding part or even the "inset" part. The inset part of the collector plate is obtained, for example, by pressing.

The lower level 12-2 may for its part be known as the "flat zone". What is meant by the expression "flat zone" is that one of the orifices 108 (or openings 108 for the passage of the tubes) is at the lower level of the collector plate (as opposed to the protruding part), that is to say level with the base 18 of the peripheral groove 14 of the collector plate. Put in yet another way, the flat zone is a zone without reliefs, therefore with no groove and no protrusion of any kind, except for the flanges around the tube passage orifices/openings.

The intermediate portion 12-3 may for its part be denoted by the term "inclined-plane part".

The inclined-plane part may also be obtained by pressing, preferably at the same time as the protruding part (or upper level) that forms the inset is formed.

In other words, in the embodiment illustrated in FIG. 2, the upper level 12-1 (or the inset-forming protruding part) is directly and without transition followed by the intermediate portion 12-3 (or inclined-plane part) to end up at the lower level 12-2 (or the end zone of the collector plate formed by the flat zone).

In this embodiment, the base 18 of the receiving groove and the lower level 12-2 both extend in the first plane. In other words, the base 18 of the receiving groove and the lower level 12-2 extend in one and the same plane (here, this is the first plane).

The upper level 12-1 itself extends in a plane parallel to the first plane.

Here, the recess 30 is positioned at the end of the collector plate 10. In other words, the recess 30 is situated near the short side 24 of the collector plate 10.

In other words, this recess is positioned facing two bends 26 and a short side 24 of the outer flange, said short side 24 being contiguous with said two bends 26. Put in yet another way, the interrupted portion of the inner flange 16 is in the shape of a U.

According to this embodiment, one of said levels (in this instance the lower level 12-2) is situated level with the recess 30 between two disjointed portions of the inner flange 16.

In this example, the recess of the outer flange 16 is contiguous with the lower level 12-2. In other words, here, the lower level 12-2 and the base 18 are not distinct and form a single level situated in one and the same plane (here, this is the first plane).

The lower level 12-2 comprises, in this embodiment, a passage hole for a tube surrounded by a flange. The flange and/or a tube will allow the gasket 104 to be held in position while the heat exchanger is being assembled. In other words, here, one of said orifices designed for the fixing of the tubes, and situated at the end of the collector plate, is situated in the flat zone. Put in yet another different way, an opening for the passage of an end tube is situated level with the lower level 12-2, the tube and/or the flange of the collector plate surrounding the end tube being capable of holding a gasket in position.

The intermediate portion 12-3 here has a slightly rounded shape and is equipped with two holes for the passage of tubes. In other words, the inclined-plane part 12-3 in this example comprises a plurality of orifices.

Further, and still in this embodiment, this inclined-plane part 12-3 has an inclination that makes an angle β of between 0 and 35° with respect to the horizontal, preferably of between 15° and 25°. Here, in the example chosen for illustrating the invention, the angle is equal to 22°.

Thus, thanks to the presence, at least at one of the ends (or short side 24) of the collector plate, of a flat zone (or a lower level 12-2), there is far more space available than in a collector plate according to the prior art, which means that a gasket can be fitted easily by an operator.

An unillustrated embodiment suggests that the collector plate 10 comprise two lower levels 12-2 each connected to the upper level 12-1 by an intermediate portion 12-3, said lower levels 12-1 being situated respectively at the two opposite ends of the collector plate 10 (or, in other words, in the region of the two short sides 24 of the collector plate 10).

Figure 5:
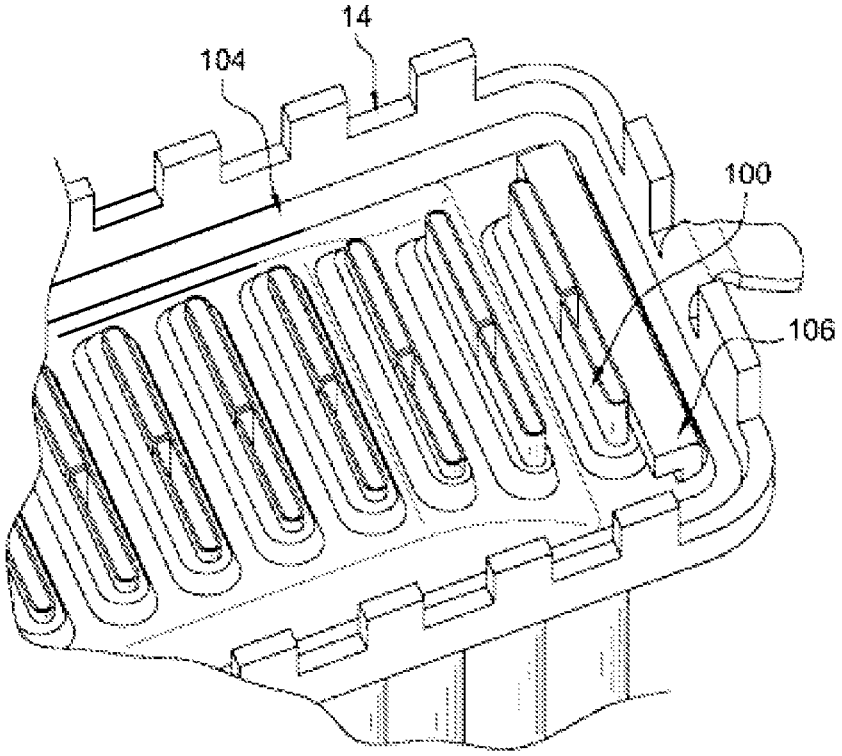
FIG. 5 depicts the collector plate of FIG. 4, with a gasket positioned and fixed notably in its groove.

Finally, as FIG. 5 illustrates, a gasket 104 is positioned in the part that forms the groove 14 because of the inset part and against the turned-up edges of the collector plate 10. Thanks to the presence, at least at one of the ends of the collector plate 10, of a flat zone (or lower level 12-2), there is far more space available (than if there were a groove 14 extending as far as the end of the plate 10), which means that the gasket 104 is easily fitted by an operator.

Moreover, the gasket 104 ideally, at least at one of its ends, or else on at least one of its short sides, comprises an end stop 106 intended to come into abutment or contact with the protruding end of the end tube. For preference, this end stop 106 exists on both opposite short sides of the gasket 106. The gasket can be mounted stretched around the end tubes.

Thus, the idea underpinning the invention is that of adapting a collector plate 10 with an inset, or of the type said to have a peripheral groove, retaining all of its advantageous features and reducing its shortcomings, in the region of the ends of the collector plate. Thus, the collector plate according to the invention consists of an inset-type collector plate the ends of which are of the flat collector type.

Figure 6:
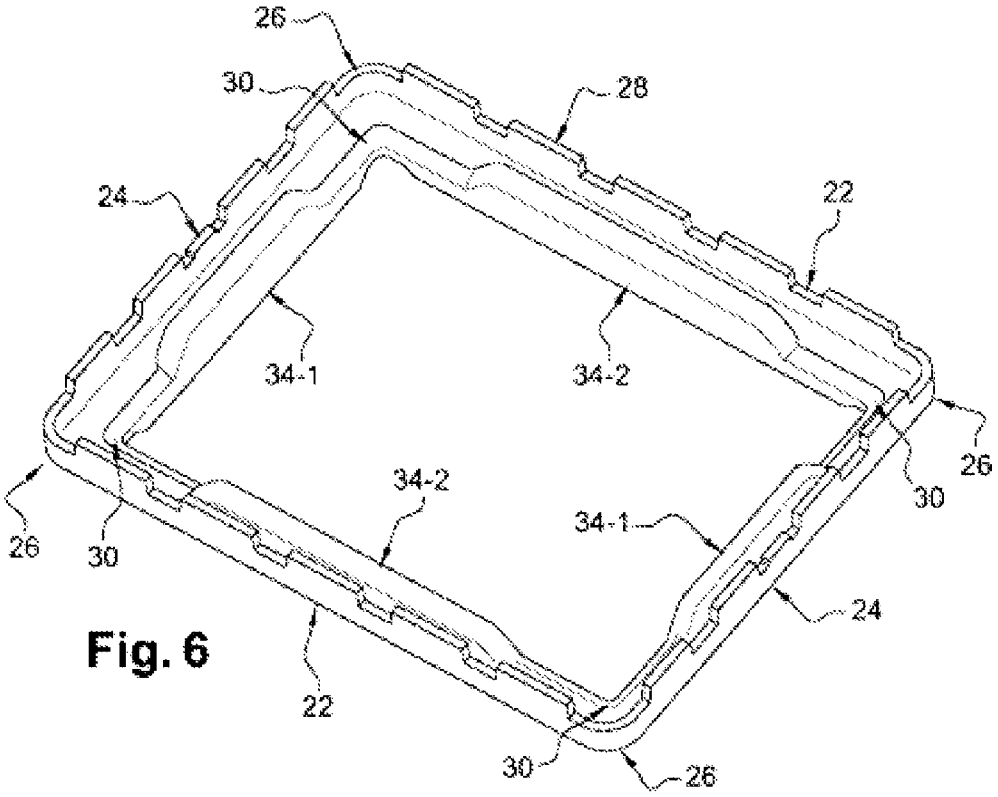
FIG. 6 depicts a view of part of a collector plate according to a second embodiment.

According to a second embodiment, illustrated in FIG. 6, the recess 30 between two disjointed portions of the inner flange 16 is positioned facing a bend 26 of the outer flange 20. In other words, in such an instance, the inner flange 16 is interrupted at a corner 26 of the collector plate 10.

Here, the inner flange 16 comprises four disjointed portions, each positioned on one of the sides of the collector plate 10. The disjointed portions 34-1, situated each on a short side 24 of the collector plate 10, are situated facing one another. Likewise, the disjointed portions 34-2, each situated on a long side 22 of the collector plate 10, are situated facing one another.

In this embodiment, the web 12 and the receiving groove 14 may be produced in two different components. The two parts will be assembled during the assembly of the heat exchanger. FIG. 6 depicts the part comprising the receiving groove 14. For simplicity, the part comprising the web 12 is not visible.

In other words, in this embodiment, the outer flange 20 comprises four straight portions 20-1 and 20-2 which are opposite one another in pairs, each straight portion being connected to an adjacent straight portion by a bend 26. The inner flange 16 at least partially faces the four straight portions 20-1 and 20-2 so as to define four recesses 30 facing each bend 26 of the collector plate.

The invention also relates to a heat exchanger comprising at least one collector plate as previously described.

Figure 7:
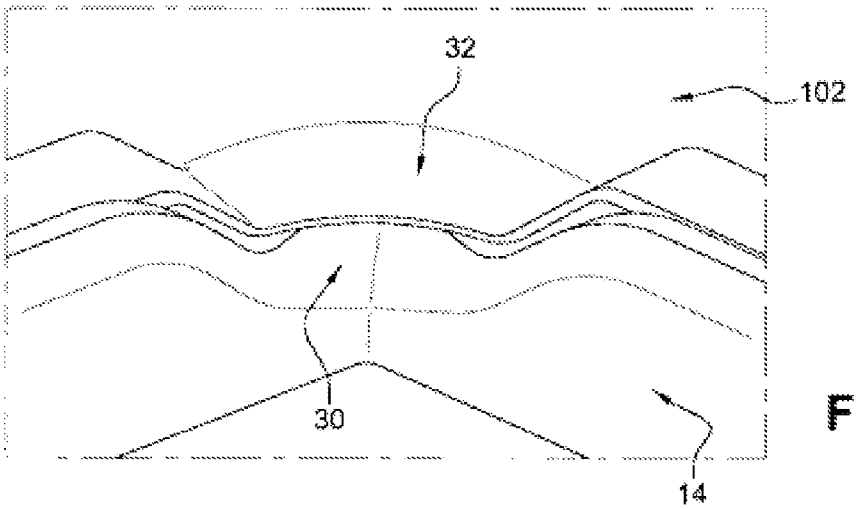
FIG. 7 depicts a detail view of a cover assembled with a collector plate according to the second embodiment.

In the example illustrated in FIG. 7, the exchanger comprises at least one cover 102. The cover 102 comprises an end, known as the foot of the cover, which is introduced into the receiving groove 14 and comprises a protrusion 32 brought to face the recess 30 of the inner flange 16. The protrusion 32 forms the join between the two disjointed sections of the inner flange 16. In other words, the protrusion 32 fills up the space created by the recess 30. Put in yet another different way, the protrusion 32 occupies said recess 30 of the inner flange 16 so as to create a join between said two disjointed sections lying on each side of the recess 30.

The invention is not restricted to the embodiments described hereinabove merely by way of example but encompasses all alternative forms conceivable to a person skilled in the art within the scope of the claims which follow. The alternative forms described hereinabove can be considered separately or in combination with one another.

The invention claimed is:

1. A collector plate (10) for a heat exchanger comprising:

a web (12) equipped with openings adapted for the passage of tubes (100) of the heat exchanger, and a U-shaped groove (14) adapted to accept a header tank cover (102) and able to accept a gasket (104) and part of the cover (102), said groove (14) having a base (18) and two flanges, respectively an inner flange (16) and an outer flange (20) which are connected to the base (18), the outer flange (20) is continuous around a periphery of the collector plate (10) and comprises four straight portions (20-1; 20-2) opposite one another in pairs, each straight portion (20-1; 20-2) being connected to an adjacent straight portion (20-1; 20-2) by a bend (26), and the inner flange (16) is connected to the web (12) of the collector plate (10) and divided into four disjointed portions (34-1; 34-2) opposite one another in pairs, each disjointed portion (34-1; 34-2) separated from an adjacent disjointed portion (34-1; 34-2) by a recess (30), whereby each disjointed portion (34-1; 34-2) is proximate a respected straight portion (20-1; 20-2) and each recess (30) is proximate a respected bend (26) so that each recess is accepting a bent part of the gasket (104), wherein the web (12) has at least two levels, an upper level (12-1) and a lower level (12-2), which are situated in two distinct planes, connected by an intermediate portion (12-3) being rounded and inclined along a first pair (34-1) of two disjointed segments (34-1; 34-2) opposing each other and planar and inclined along a second pair (34-2) of two disjoined segments (34-1; 34-2) opposing each other, the lower level (12-2) extending in a region of the recess (30) between the two disjointed portions (34-1; 34-2), and wherein the base (18) of the groove (14) and the lower level (12-2) combine to form a flat zone extending continuously longitudinally and laterally in one and the same plane known as a first plane.

2. The collector plate (10) as claimed in claim 1, in which the groove (14) has at least two substantially parallel sides and in which the two disjointed portions (34-1; 34-2) are placed facing one another, each on one of the parallel sides (22).

3. The collector plate (10) as claimed in claim 1, in which an opening for the passage of an end tube (100) is situated level with the lower level (12-2), the end tube (100) and/or a flange of the collector plate (10) surrounding the end tube (100) being capable of retaining the gasket (104).

4. The collector plate (10) as claimed in claim 1, in which the groove (14) and the web (12) are made in two different components.

5. A heat exchanger comprising at least one collector plate (10) as claimed in claim 1.

6. The heat exchanger as claimed in claim 5, comprising at least one cover (102), the cover (102) comprising an end that is introduced into the groove (14) and comprises a protrusion (32) that fills the recess (30) of the inner flange (16) so as to create a junction between the two disjointed portions (34-1; 34-2) located on each side of the recess (30).

7. The collector plate (10) as claimed in claim 1, in which the groove (14) has at least two substantially parallel sides and in which the two disjointed portions (34-1; 34-2) are placed facing one another, each on one of the parallel sides (22).

* * * * *